United States Patent [19]

Tilston et al.

[11] Patent Number: 4,491,849

[45] Date of Patent: Jan. 1, 1985

[54] RADIO ANTENNA

[76] Inventors: William V. Tilston, P.O. Box 550, Kemptville, Ontario, Canada, K0G 1J0; Stephen E. Tilston, General Delivery, Oxford Mills, Ontario, Canada, K0G 1S0

[21] Appl. No.: 341,348

[22] Filed: Jan. 21, 1982

[51] Int. Cl.[3] ..... H01Q 1/12; H01Q 9/34

[52] U.S. Cl. ..... 343/791; 343/792; 343/830; 343/845; 343/890

[58] Field of Search ..... 343/790–792, 343/794, 820–822, 890, 891, 824–830, 844–849, 874, 875, 878, 886, 904, 905

[56] References Cited

U.S. PATENT DOCUMENTS

| | | | |
|---|---|---|---|
| 2,131,105 | 9/1938 | Lindenblad | 343/821 |
| 2,234,234 | 3/1941 | Cork et al. | 343/790 |
| 2,802,210 | 8/1957 | Berndt | 343/792 |

FOREIGN PATENT DOCUMENTS

| | | | |
|---|---|---|---|
| 863102 | 1/1953 | Fed. Rep. of Germany | 343/792 |
| 880158 | 6/1953 | Fed. Rep. of Germany | 343/792 |

OTHER PUBLICATIONS

Biro, "Analysis and Design Technique of the Gamma Matched Dipole" Microwave Communication Conference, 4–70.

*Primary Examiner*—Eli Lieberman
*Assistant Examiner*—Michael C. Wimer
*Attorney, Agent, or Firm*—Kenyon & Kenyon

[57] ABSTRACT

There is provided a new and useful radio antenna comprising a mast; a pair of radiating elements mounted on the mast, and being oriented in a plane, and having one end of one element adjacent to one end of the second element; a coaxial feeder the outer conductor of which is joined to the first element of the pair at approximately the midpoint of the first element and having its center conductor extending to a predetermined feedpoint on the second element, this predetermined point being that at which the center conductor will be substantially impedance matched with the antenna; and, wherein the spacing of the gap between the adjacent ends of the first and second elements is such that the elements are fed by the feedpoint across the gap to provide a matched output of the pair of elements having the desired beam tilt.

This application relates to radio wave transmission and reception antennas.

14 Claims, 5 Drawing Figures

$\therefore I_1' = n(I_1 + I_2)$ $I_2' = (1-n)(I_1 + I_2)$ $I_1'' = (1-n)I_1 - nI_2$ $I_2'' = -(1-n)I_1 + nI_2$ AND $I_3' = n(I_3 + I_4)$ $I_4' = (1-n)(I_3 + I_4)$ $I_3'' = (1-n)I_3 - nI_4$ $I_4'' = (1-n)I_3 + nI_4$ $\frac{1}{n} I_1' = \frac{1}{(1-n)} I_2'$ $I_1'' = -I_2''$ $I_1 = I_1' + I_1''$ $I_2 = I_2' + I_2'' = I_2'' - I_1''$ $\therefore I_1 + I_2 = I_1' + I_2' = I_1' + \left(\frac{1-n}{n}\right) I_1' = \frac{1}{n} I_1'$ $\therefore I_1' = n(I_1 + I_2)$

RADIO ANTENNA

BACKGROUND OF THE INVENTION

It is generally the case that low-cost antenna arrays currently in use transmit over only a very small part of the useable radio bandwidth. At the desired gain these units typically cover only 5 to 10% of the bandwidth. While this performance may be acceptable for a specific purpose, it does not allow for changing purposes. Thus, where a different section of the bandwidth is desired to be covered, adjustments will be necessary. Typically these adjustments involve moving the ground rods, altering the radiators, using several antennas, and the like.

This lack of full bandwidth is a particular disadvantage in the case of leased antennas. In this situation great expense is involved either in building new antennas for specific jobs or in maintaining a large stock on hand to suit various requirements.

Against this background the present invention provides an antenna which is capable of transmitting or receiving over 100% of the required bandwidth. A single basic antenna is thus useable for a wide range of transmitting or receiving requirements.

PRIOR ART

It has generally been the case that off-the-mast antennas for the transmission and reception of radio waves have consisted of half wave dipoles or folded dipoles mounted colinearly in the case of vertical polarization parallel to the vertical mast. These dipoles are held in place by horizontal support arms extending from their mid-points to the antenna mast. For purposes of increasing gain, the dipoles may be stacked one above the other with a separate feed point, feed line, and support arm being utilized for each dipole.

Various other antenna configurations have been used in the prior art in various applications. Various disadvantages and inefficiencies arise with respect to each type. The problems include difficulty of construction, expense of construction and the need to minimize these factors while still obtaining the necessary bandwidth and other indicia of acceptable performance.

A further serious difficulty presented by a number of prior art configurations is that of providing adequate grounding to protect against lightning strikes.

In addition to these more specific difficulties, these typical antennas suffer from the general problem of very narrow bandwidth discussed above. The present invention deals with an antenna which is directed toward the alleviation of a number of these problems in the prior art.

SUMMARY OF THE INVENTION

An antenna is provided by the present invention wherein a pair of radiating or receiving elements are provided which are fed through a single feed point. The structure is such that a very efficient antenna can be more simply and economically produced than is presently the case and that the antenna is capable of radiating over a wide bandwidth while maintaining both a good input impedence and radiation pattern.

There is thus provided by the invention a radio antenna comprising a mast, a pair of radiating elements mounted on said mast, said elements oriented in a common plane and having one end of one element adjacent to one end of the second element, a coaxial feeder having its outer conductor joined to the first element of said pair at approximately the midpoint of said element and having its centre conductor extending to a predetermined feedpoint on the second of said elements, said predetermined point being that at which said centre conductor will be substantially impedance matched with the antenna, and wherein the spacing of the gap between the adjacent ends of said first and second elements is such that said first element is fed by said feedpoint across said gap to provide a matched output of said pair of elements having the desired beam tilt and input impedance.

The approximate mid-point of each element may be grounded to a metallic support mast.

GENERAL DESCRIPTION

The basis of the present invention lies in the utilization of a single feed point to power two radiating elements, typically halfwave dipoles. The mid-point of each element may be grounded to a support mast. The feed conductor is impedance matched to the antenna to avoid return waves in the conductor and consequent power loss. The result is to provide an antenna which can effectively transmit and receive over a wide bandwidth.

A typical structure according to the invention utilizes two elongated radiating elements arranged in a common plane. One end of a first element is arranged adjacent one end of the second element. The actual spacing between the ends is related to the single feed concept and the requirement for matched outputs for the elements, both of which are discussed below.

The elements are conveniently of tubular metal or pipe and in a typical basic installation are mounted on a mast by means of similar tubular conductive supports. This tubular metal aspect of the invention provides substantial additional protection against lightning strikes, since the solidly grounded mast completes a ground path from the elements.

In this typical tubular constructed embodiment of the invention, a new design concept is introduced. Previous designs of this type using half wave elements would have the supports for the elements connected at the ends of the elements and use some type of balun transformer to suppress feed-line currents. The present invention contemplates a design where the mounting support is connected to the mid-point of the elements, since that is a zero voltage point. It is this factor which facilitates the greatly enhanced grounding in this embodiment.

Various arrangements of the above-described elements are possible. For example, the elements may be arranged vertically with colinear axes, horizontally with or without colinear axes, or in other configurations as desired to achieve a given broadcast pattern.

The common feature of these arrangements lies in the manner of feeding and in the feed line impedance matching.

Thus, in each case the feedline is a coaxial cable or the like, the outer conductor of which terminates at a connection at approximately the mid-point of the first element. In the case of the tubular members with the support connected at the mid-point, the coaxial cable is conveniently attached at the junction between the element and the support. In some variations of this design, the coaxial feeder could be replaced by striplines or microstrip feeding.

The center conductor from the coaxial cable is then fed to the actual feedpoint on the second element at which the center conductor section is impedance matched with the antenna. This matching provides for a much enhanced power output from the conductor and is a key to the success of the invention.

The electric field set up from the feedpoint between the two conductors across the inter element gap serves to power both elements. The gap is adjusted to obtain maximum power in both elements; while at the same time the outputs of the two elements are matched to obtain the desired beam tilt. The gap can be adjusted by trial and error to optimize operation in view of these joint objections.

The positioning of the feedpoint and the spacing of the elements can be generally determined mathematically and subsequently optimized by simple empirical experiments.

Each element is most conveniently half a wavelength long, the wavelength generally chosen at the center frequency of the design bandwidth.

Where a support is utilized for the element, the support is conveniently an eighth to a quarter wavelength long.

BRIEF SUMMARY OF THE DRAWINGS

In drawings which illustrate embodiments of the invention.

SUMMARY OF THE THEORETICAL DERIVATION

In order to be used as a research and a development tool it is not essential, initially, that a theory be extremely rigorous or that it be capable of solving any particular case with great accuracy. What is needed is a theory which gives one an understanding of the physical situation such that it becomes clear what should be done in order to solve a given problem.

Of the various ways of describing antenna behavior mathematically, the lossy transmission line approach is one of the few which contributes to our physical insight. The reason it does so is that although approximate, it presents its description in terms of familiar network concepts and allows us to bring to bear upon the problem all of the large body of network theory which has been built up.

Figure 4:
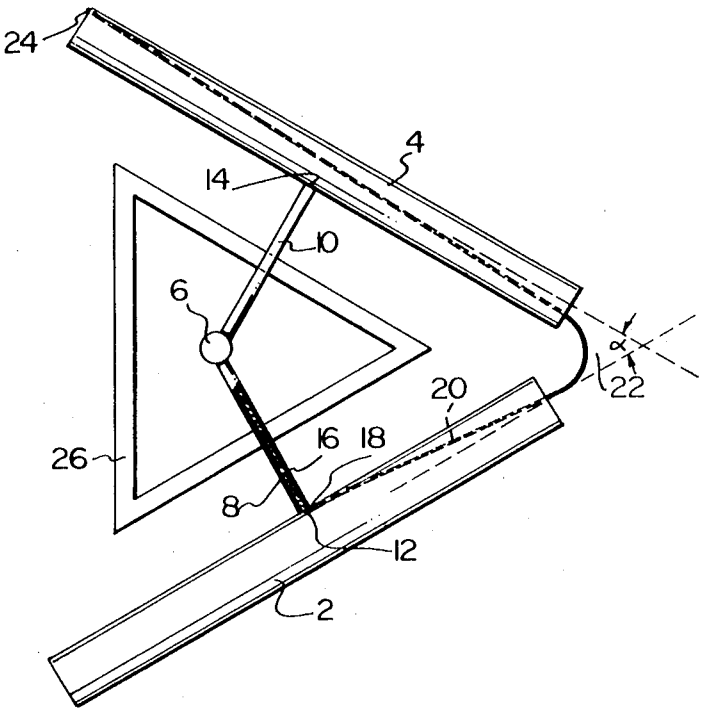
FIG. 4 is a sketch of a plan view of a second form of antenna according to the invention; and, FIG. 5 is a sketch of an elevational view of a third form of antenna according to the invention.
Figure 3:
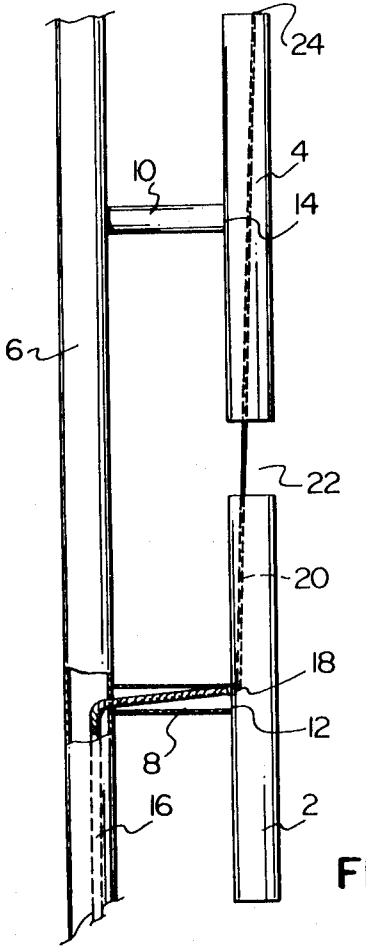
FIG. 3 is a sketch of an elevational view of one form of antenna according to the invention.
Figure 5:
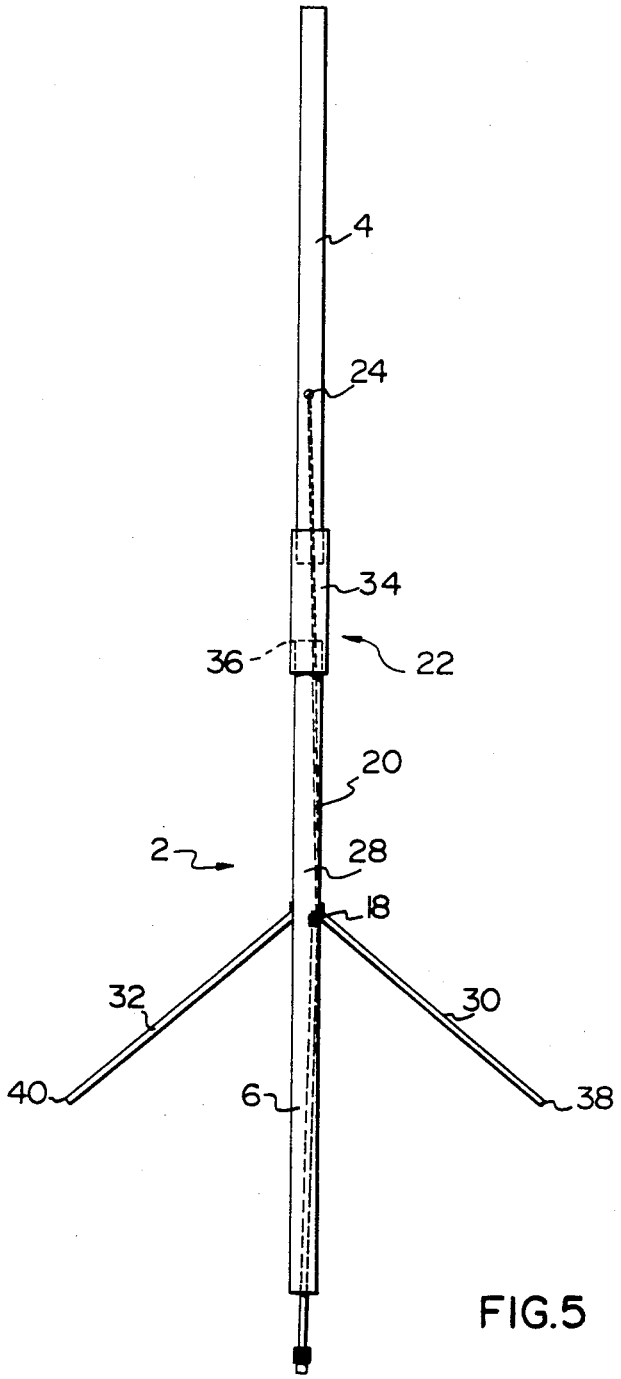

Looked upon as a network problem, the antenna situations represented in FIGS. 3 to 5 can be dealt with by considering a four port network, or two coupled two-ports.

To do this, it is necessary to deal only with that part of the mast directly opposite the antenna. Experimental data confirmed that the mast currents were confined primarily to this region. Instead of dealing with the full wave dipole off a long (or infinitely long) mast it proves somewhat more convenient to consider the case of half a full wave array above a perfectly conducting plane. This is essentially the same problem since the full wave dipole solution is obtained merely by adding the image of the half wave antenna in the ground plane.

Figure 1:
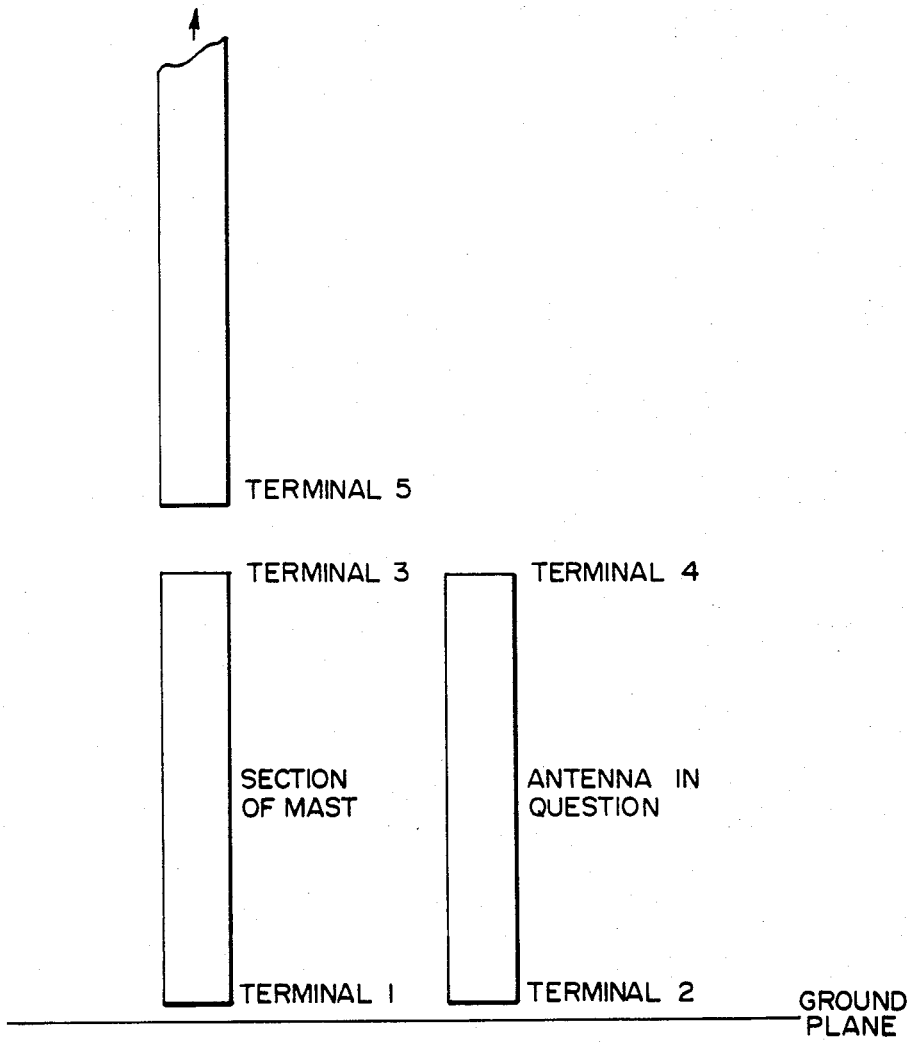
FIG. 1 is a sketch of an antenna off a mast model useful as a theoretical model for the present invention.

A schematic of the situation to be considered here is shown in FIG. 1. For present purposes, a generator will be placed between terminal 2 and ground; terminal 1 will be connected to ground; and terminal 3 will have the impedance of an infinitely long antenna attached to it by connecting terminals 5 and 3 together.

Figure 2:
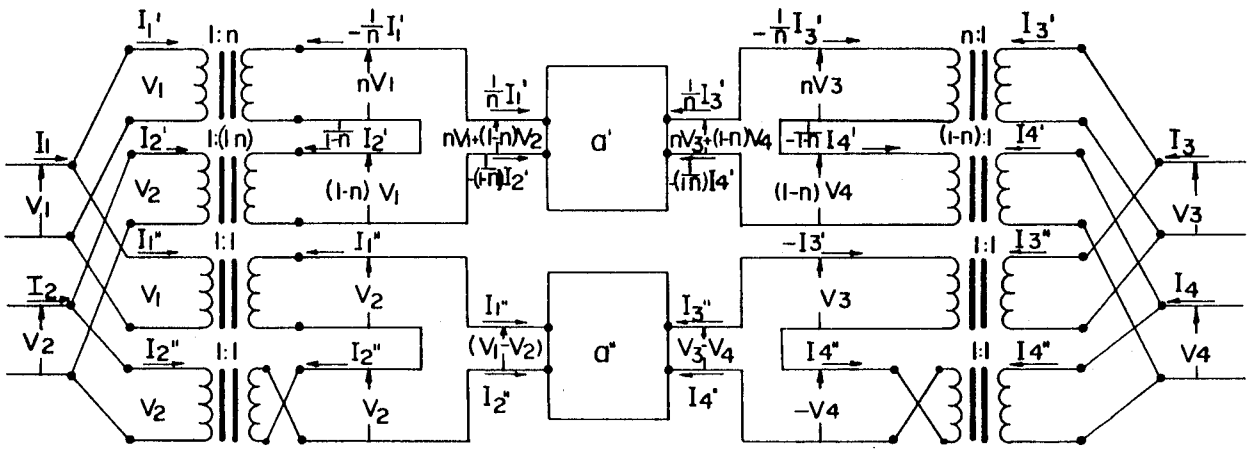
FIG. 2 is an equivalent circuit for the model of FIG. 1.

Thus the whole antenna system can be described by the equivalent circuit shown in FIG. 2. Although the integral equation formulation is more elegant mathematically, it does not allow this same insight of formulation. In recent years it has been the tendency in North America at least to use the integral equation technique due largely to the appeal of its mathematical rigor.

Using the lossy transmission line, or network, approach, the input impedance of the structure considered in FIG. 1 can be reduced to the following formula:

$$\frac{V_2}{I_2} = \frac{-[(C_u \cdot Z_s + S_u \cdot Z_u) \cdot C_b + (1-n)^2 \cdot C_u \cdot Z_b \cdot S_b]}{(1-n)^2\left[2 - 2 \cdot C_b \cdot C_u - \frac{S_u \cdot C_b \cdot Z_s}{Z_u}\right] - (1-n)^4 \cdot \frac{S_u \cdot S_b \cdot Z_b}{Z_u} - (Z_s \cdot C_u + S_u \cdot Z_u)\frac{S_b}{Z_b}}$$

Here $(V_2/I_2)$ is the input impedance $Z_{in}$.

$Z_u$=characteristic impedance of the unbalanced mode $Z_b$=characteristic impedance of the balanced mode $Z_s$=impedance at terminal 3

$C_u$, $C_b$, $S_u$, $S_b$ are functions which depend on the antenna length, diameter, etc.

From this equation one can put on the appropriate boundary conditions for known antennas such as an antenna in free space $$Z_{in} \longrightarrow Z_u \frac{C_u}{S_u}$$

and a folded dipole $$\left(Z_{in} = 4Z_u \frac{C_u}{S_u}\right).$$

In each case the usual behavior for these antennas can be easily predicted. This illustrates the simplicity of the method.

A further simplification can be obtained for the above general equation as follows:

$$Z_{in} = \frac{Z_u C_u}{(1-n)^2 S_u}\left[1 - \frac{(C_u+1)^2}{\left(2 + 2\,C_u + \frac{S_u Z_s}{Z_u}\right) C_u}\right]$$

For the specific situation under consideration, for the reciprocal of the input impedance $(Y_{in})$, this reduces to:

$$Y_{in} \sim (1-n)^2 \frac{S_u}{C_u \cdot Z_u} + \frac{S_b}{C_b \cdot Z_b}$$

It can thus be predicted that it should be possible to obtain a reasonably high impedance and a wide bandwidth if a center fed full wave dipole is placed adjacent to a mast even at fairly close spacings.

DETAILED DESCRIPTION OF THE PREFERRED EMBODIMENTS

In the following description, similar features have been given similar reference numerals.

FIG. 3 illustrates one preferred embodiment of the invention in which the radiating elements 2 and 4 are mounted on the mast 6 by means of the supports 8 and 10. Elements 2 and 4 are mounted in a vertical orientation and are colinear one above the other. The mast 6 is vertically disposed and supports 8 and 10 are substantially horizontal.

Supports 8 and 10 are attached to elements 2 and 4 at the mid-points 12 and 14 respectively of those elements.

Each of elements 2 and 4, mast 6 and supports 8 and 10 are preferably constructed of tubular metal such as pipe. A coaxial feeder 16 is then fed up through or beside the mast 6 and the support 8 and has an outer conductor attached at the junction 18 of support 8 with the element 2. A center conductor 20 of the cable 16 is then continued up through the interior of element 2, across the gap 22 between elements 2 and 4, and through the interior of element 4 to a ground termination point 24.

Each of elements 2 and 4 will usually be half wavelength dipoles, although this is not essential. The wavelength is chosen at the center frequency of the design bandwidth. Supports 8 and 10 are then generally an eighth to a quarter wavelength.

The spacing 22 between elements 2 and 4 is the gap across which the element 2 and the element 4 are driven. The gap is chosen to provide maximum power to element 2 and element 4 consistent with a matched output of the two elements.

The ground termination point 24 is chosen to match the impedance of center conductor 20 to that of the antenna. The point 24 can be approximately determined mathematically for a given antenna, but the variables in the structure generally require some empirical testing to arrive at the optimum point. In the FIG. 3 embodiment the preferred location for feedpoint 24 is at the end of element 4 and toward the opposite side of element 2 from the cable termination point 18. The actual location of the point 24 on the end of the element 4 is generally within the 180° section of the circumference of that end that is disposed on the side of the element opposite the mid-point of support 8. The point depends On the type of cable used and may fall outside the 180° section.

The embodiment illustrated in FIG. 4 is very similar in essential respects to the FIG. 3 embodiment. The main differences are that the FIG. 4 embodiment illustrates the elements 2 and 4 arranged in a horizontal orientation on a common plane and with an angle $\alpha$ between those elements.

The reference numerals in FIG. 4 illustrate components which function in exactly the same way as in FIG. 3. A series of pairs of radiating elements arranged as in the FIG. 4 case around the triangular support 26 provides an omnidirectional antenna with the attendant advantages.

A preferred structural alteration which will provide for maximum power transmission from elements 4 and 2 is to profile the adjacent corners of the elements.

The embodiment illustrated in FIG. 5 is again very similar to that of the preceding two embodiments in that the same components are present functioning in the same way. Among the differences from the first two embodiments are that the element 2 is comprised of a section 28 of the mast 6 in combination with three or more grounding rods 30, 31 (not illustrated) and 32. The element 4 is mounted vertically directly above the mast 6 by means of a non-conductive sleeve 34. Supports 8 and 10 are absent in this embodiment.

The section 28 is preferably a quarter wavelength, as are the rods 30 and 32. Thus the overall radiating element 2 comprises a half wavelength from point 36 at the top of section 28 to either of point 38 to 40 at the ends of rods 30 and 32 respectively.

The coaxial cable extends in this case to approximately the mid-point of element 2 which is the point at which rods 38 and 40 join mast 6. The center conductor 20 extends to the point 24 in element 4 at which conductor 20 is matched in impedance to the antenna.

There are generally at least two points in each of these structures at which the conductor 20 may be connected to provide the necessary impedance matching. From the practical point of view when utilizing metal tubing, it is much easier to build the antenna when the feedpoint is at the end of the radiating element.

What is claimed is:

1. A radio antenna comprising:

a mast;

a pair of conductive supports mounted on said mast;

a pair of radiating elements, each said radiating element being joined at a midpoint thereof to a respective support for mounting on said mast, said elements oriented in a plane and having one end of one element adjacent to one end of the second element;

a coaxial feeder having an outer conductor joined to the first element of said pair of elements at a junction of said first element with a respective support and having a center conductor extending to a predetermined feedpoint on the second of said elements, said predetermined point being that at which said center conductor will be substantially impedance matched with the antenna; and wherein the spacing of a gap between the adjacent ends of said first and second elements is such that said elements are fed by said feedpoint across said gap to provide a matched output of said pair of elements having a desired beam tilt.

2. The antenna of claim 1 wherein each of the mast, the elements, and the conductive supports is of tubular metal.

3. The antenna of claim 2 wherein said center conductor extends within said tubular elements, except for that portion of said center conductor extending across the gap between said elements.

4. The antenna of claim 3 wherein each said pair of elements is oriented in a colinear manner along a horizontal or vertical axis.

5. The antenna of claim 4 wherein said single conductor terminates at the end of said second element remote from said first element and at a point on the circumference of that end at which the antenna provides maximum bandwidth.

6. The antenna of claim 5 wherein said point lies at an angular distance from about 90° to about 90° in either direction from a point on said circumference opposite to said junction.

7. The antenna of claim 1 wherein each said element is a half wavelength dipole, the wavelength being chosen at or near the center of the design frequency bandwidth.

8. The antenna of claim 7 wherein said elements are spaced from said mast by said conductive supports a distance of an eighth to a half wavelength.

9. The antenna of claim 3 wherein each said pair of elements is oriented in a horizontal plane and wherein the two elements of each pair are at a predetermined angle to each other.

10. The antenna of claim 9 wherein the adjacent corners of said elements are profiled to obtain maximum power and a matched output from said elements.

11. A radio antenna comprising:

a mast;

a pair of conductive supports mounted on said mast;

a pair of radiating elements, each said radiating element being joined at a midpoint thereof to a respective support for mounting on said mast, said elements oriented in a plane and having one end of one element spaced from one end of the second element to define a gap of a size to provide maximum power to said elements consistent with a matched output of said elements; and a coaxial feeder having an outer conductor joined to said one element at a junction of said one element with a respective support and a center conductor extending to a predetermined feed point on said second element, said predetermined point being that at which said center conductor is substantially impedance matched with the antenna.

12. The antenna of claim 11 wherein each said element and said conductive support is of tubular metal.

13. The antenna of claim 11 wherein elements are oriented in a horizontal plane and at a predetermined angle to each other.

14. A radio antenna comprising a mast having a top section equal in length to a quarter wavelength at a center frequency of a design bandwidth and at least three grounding rods of quarter wavelength at said center frequency extending downwardly at an angle from a lower end of said top section and distributed about said mast;

a tubular metal section oriented vertically and in colinear relation with said top section of said mast, said metal section being of one half wavelength at said center frequency;

a non conductive support mounting said tubular metal section on said top section of said mast;

a coaxial feeder having an outer conductor joined to said top section at a junction of said rods with said top section and having a center conductor extending to a predetermined feedpoint on said metal section, said predetermined point being that at which said center conductor is substantially impedance matched with the antenna; and, wherein the spacing of a gap between the adjacent ends of said top section and said metal section is such that said sections are fed by said feedpoint across said gap to provide a matched output of said sections having a desired beam tilt.

* * * * *